US010344441B2

(12) United States Patent
GangaRao et al.

(10) Patent No.: US 10,344,441 B2
(45) Date of Patent: Jul. 9, 2019

(54) FIBER-REINFORCED POLYMER SHELL SYSTEMS AND METHODS FOR ENCAPSULATING PILES WITH CONCRETE COLUMNS EXTENDING BELOW THE EARTH'S SURFACE

(71) Applicant: West Virginia University, Morgantown, WV (US)

(72) Inventors: Hota V. S. GangaRao, Morgantown, WV (US); Kumar Venkatesh Karri, Morgantown, WV (US); Jerry Nestor, Independence, WV (US)

( * ) Notice: Subject to any disclaimer, the term of this patent is extended or adjusted under 35 U.S.C. 154(b) by 43 days.

(21) Appl. No.: 15/170,463

(22) Filed: Jun. 1, 2016

(65) Prior Publication Data

US 2016/0348330 A1 Dec. 1, 2016

Related U.S. Application Data

(60) Provisional application No. 62/169,039, filed on Jun. 1, 2015.

(51) Int. Cl.

| | |
|---|---|
| ***E02D 5/22*** | (2006.01) |
| ***E02D 5/60*** | (2006.01) |
| ***E02D 5/56*** | (2006.01) |
| ***E02D 7/14*** | (2006.01) |
| ***E02D 7/22*** | (2006.01) |
| ***E02D 27/12*** | (2006.01) |

(52) U.S. Cl.

CPC ..... *E02D 5/56* (2013.01); *E02D 5/226* (2013.01); *E02D 7/14* (2013.01); *E02D 7/22* (2013.01); *E02D 27/12* (2013.01)

(58) Field of Classification Search

CPC .. E02D 5/56; E02D 5/226; E02D 5/72; E02D 7/22

See application file for complete search history.

(56) References Cited

U.S. PATENT DOCUMENTS

| | | | | |
|---|---|---|---|---|
| 1,813,375 A | | 7/1931 | Wright et al. | |
| 1,947,413 A | | 2/1934 | Hay | |
| 2,023,966 A | * | 12/1935 | Montee | E02D 7/22 173/141 |
| 2,897,553 A | * | 8/1959 | Gorrow | E04H 12/2292 405/216 |
| 3,638,433 A | * | 2/1972 | Sherard | E02D 1/04 405/50 |

(Continued)

OTHER PUBLICATIONS

Shafaei, J, Hosseini, A, and Marefat, M, "Rehabilitation of Earthquake External RC Beam-Column Joints", NZSEE (2014).

(Continued)

*Primary Examiner* — Benjamin F Fiorello

(74) *Attorney, Agent, or Firm* — Dinsmore & Shohl LLPL; Monika L'Orsa Jaensson

(57) ABSTRACT

Generally, the disclosed technology regards a novel auger annulus adjoinable to a shell useful in encapsulating structural piles to below the earth's surface. The disclosed technology further regards a jacket and auger annulus system useful in encapsulating structural piles. Also provided is a method of positioning a first fiber-reinforced polymer (FRP) circular-cylindrical shell at and about the exposed base of a structural pile, thereby encapsulating the pile to below the earth's surface using a jacket and auger annulus.

27 Claims, 6 Drawing Sheets

(56) References Cited

U.S. PATENT DOCUMENTS 3,999,620 A 12/1976 Watson
4,068,396 A * 1/1978 Langguth ..... A01G 23/046 111/101
4,644,715 A * 2/1987 Burell ..... E04H 12/2292 175/262
4,669,786 A 6/1987 Morgan et al.
4,697,649 A * 10/1987 Kinnan ..... E21B 7/20 175/162
4,764,054 A 8/1988 Sutton
4,915,544 A * 4/1990 Lin ..... E02D 5/385 405/239
5,222,566 A * 6/1993 Taylor ..... E21B 10/43 175/378
5,435,667 A 7/1995 Strange
5,957,225 A * 9/1999 Sinor ..... E21B 7/061 175/171
6,048,137 A * 4/2000 Beck, III ..... E02D 5/385 405/233
6,129,163 A * 10/2000 Hamilton ..... E21B 10/02 175/320
6,142,712 A * 11/2000 White ..... E02D 5/40 175/220
6,176,332 B1 * 1/2001 Massa ..... E21B 10/55 175/420.1
6,364,575 B1 4/2002 Bradley et al.
6,675,919 B2 * 1/2004 Mosing ..... E21B 7/20 166/358
6,773,206 B2 8/2004 Bradley et al.
7,275,349 B2 10/2007 Auman
7,413,035 B1 * 8/2008 Miller ..... E21B 7/201 175/171
8,418,784 B2 4/2013 Hall et al.
8,661,640 B2 * 3/2014 Parrott ..... E21C 35/197 29/252
8,757,293 B2 6/2014 Livingstone
2006/0198706 A1 * 9/2006 Neville ..... E02D 5/56 405/252.1
2008/0100125 A1 5/2008 Staples
2010/0263929 A1 * 10/2010 Ditillo ..... E02D 5/36 175/19
2013/0014468 A1 1/2013 Ehsani
2014/0119837 A1 * 5/2014 Reinhall ..... E02D 7/02 405/232

OTHER PUBLICATIONS

Pimanmas, A, and Chaimahawan, P, "Shear strength of beam-column joint with enlarged joint area", Engineering Structures 32 (2010), 2529-2545.
Misir, I, and Kahraman, S, "Strengthening of Non-Seismically Detailed Reinforced Concrete Beam-Column Joints using SIFCON Blocks", Sadhana vol. 38, Part 1, 69-66 (2013).
Said, A.M. and Nehdi, M.L., "Use of FRP for RC Frames in Seismic Zones: Part I. Evaluation of FRP Beam-Column Joint Rehabilitation Techniques", Applied Composite Materials 11:205-226 (2004).
Sharma, A, Eligehausen, R, and Hofmann, J, "Numerical Modeling of Joints Retrofitted with Haunch Retrofit Solution", ACI Structural Journal, 861-872 (2014).
Ghobarah, A, and El-Amoury, T, "Seismic Rehabilitation of Deficient Exterior Concrete Frame Joints", Journal of Composites for Construction, 408-416 (2005).
Engindeniz, M, Kahn, L, and Zureick, A., "Repair and Strengthening of Reinforced Concrete Beam-Column Joints: State of the Art", ACI Structural Journal, (2005).

* cited by examiner

FIBER-REINFORCED POLYMER SHELL SYSTEMS AND METHODS FOR ENCAPSULATING PILES WITH CONCRETE COLUMNS EXTENDING BELOW THE EARTH'S SURFACE

BACKGROUND OF THE DISCLOSED TECHNOLOGY

The present technology regards systems and methods for encapsulating corroded or deteriorated steel or concrete piles of bridges and other structures with concrete columns, below the mud line or earth's surface, using a novel fiber-reinforced polymer shell system having an auger attachment. Although particularly useful for reinforcing deteriorated piles and columns, the technology may further be used on new or in-service non-deteriorated support structures.

Prior to the development of the present technology, corroded or deteriorated structural piles and columns were reinforced by means of jackets or shells, positioned and secured about the structure, above the earth's surface. To extend the reinforcing structure below the earth's surface, the pile or column site had to be excavated. However, excavation can be costly, inefficient and at some sites difficult or practically impossible. The present invention provides a practical, cost effective and user friendly component, system and method for reinforcing deteriorated structural piles and columns to below the earth's surface.

GENERAL DESCRIPTION OF THE DISCLOSED TECHNOLOGY

Generally, the disclosed technology regards a novel auger annulus adjoinable to a shell useful in encapsulating structural piles to below the earth's surface. The disclosed technology further regards a jacket and auger annulus system useful in encapsulating structural piles. Also provided is a method of positioning a first fiber-reinforced polymer (FRP) circular-cylindrical shell at and about the exposed base of a structural pile, thereby encapsulating the pile to below the earth's surface using a jacket and auger annulus.

The auger annulus of the disclosed technology includes a plurality of arced members, joinable to form a circle, with each member having one or more blades extending from the bottom surface of the arced member.

The system of the disclosed technology generally includes a jacket having a longitudinal cut extending from the top to the base of the jacket, and an auger annulus adjoinable to the jacket base. In the system the auger annulus includes a plurality of arced members which join to form a circle, wherein each arced member includes one or more blades extending from the bottom surface of the arced member.

The present method for encapsulating a structural pile to below the earth's surface includes positioning about the pile a jacket having a longitudinal cut extending from the jacket's top to its base, and further positioning about the pile an auger annulus. The auger annulus has a plurality of arced members joinable to form a circle, each arced member includes one or more blades extending from the bottom surface of the arced member. Once the jacket and annulus are positioned about the pile, the auger annulus is adjoined to the base of the jacket and the longitudinal cut of the jacket is sealed to form a shell column. Thereafter, a fiber reinforced polymer wrap is wound about the shell column. Applying force to the shell column and annulus causes the column to bore into the earth's surface to a desired depth. Finally, the shell column is filled with a cementitious composition.

DETAILED DESCRIPTION OF THE DISCLOSED TECHNOLOGY

Figure 5:
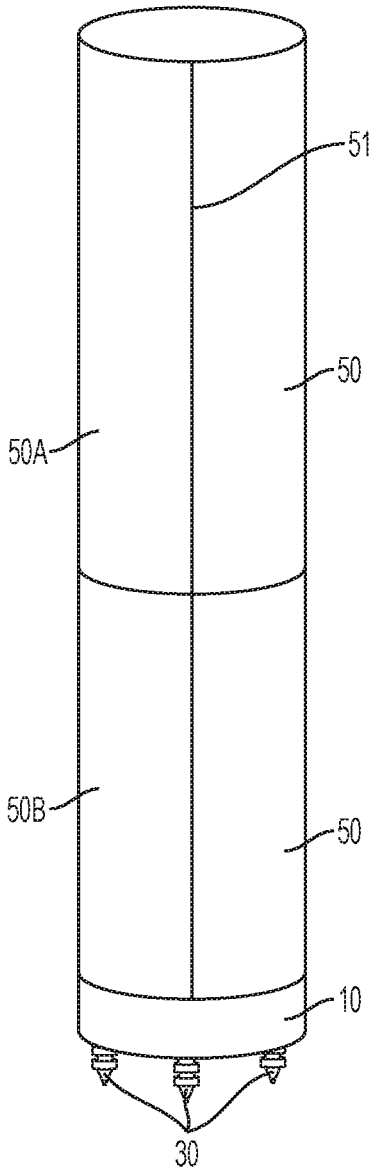
FIG. 5 is a perspective view of the system of the disclosed technology.
Figure 6:
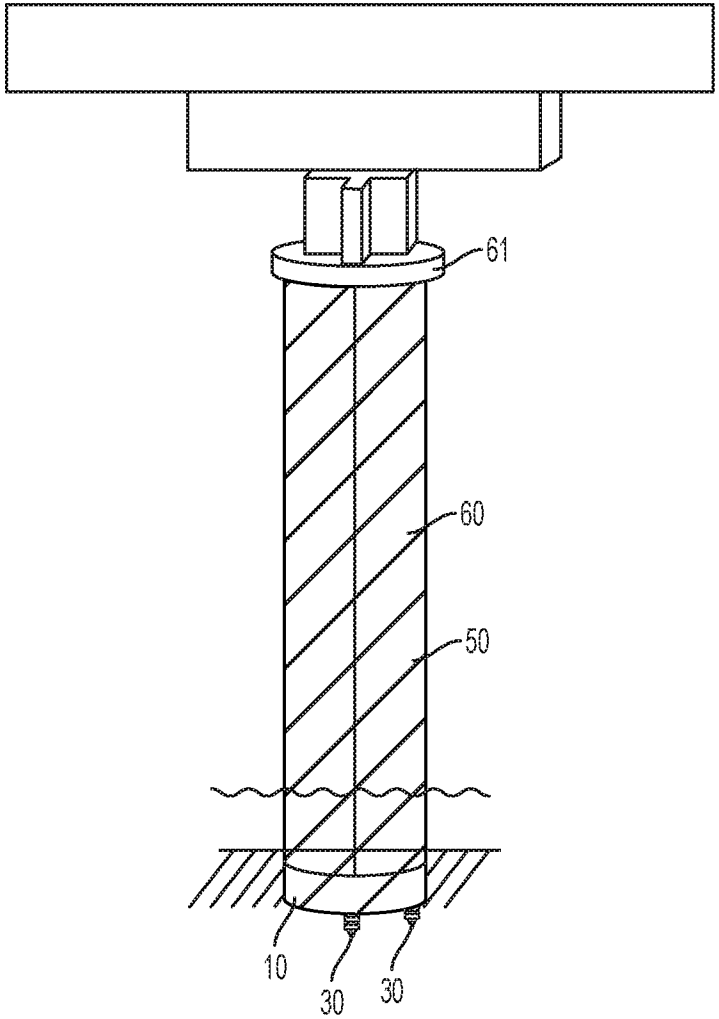
FIG. 6 is a perspective view of the system of the disclosed technology, positioned about a structural column, and below the water and earth surface.

As shown in the embodiments depicted in FIGS. 1-6, the disclosed technology regards a novel auger annulus 10 adjoinable to a shell useful in encapsulating structural piles above and below the earth's surface. The disclosed technology further regards a jacket 50 and auger annulus 10 system useful in encapsulating structural piles, an embodiment of which is illustrated in FIGS. 5 and 6, and a method of encapsulating a structural pile to below the earth's surface using a jacket and auger annulus.

Figure 1:
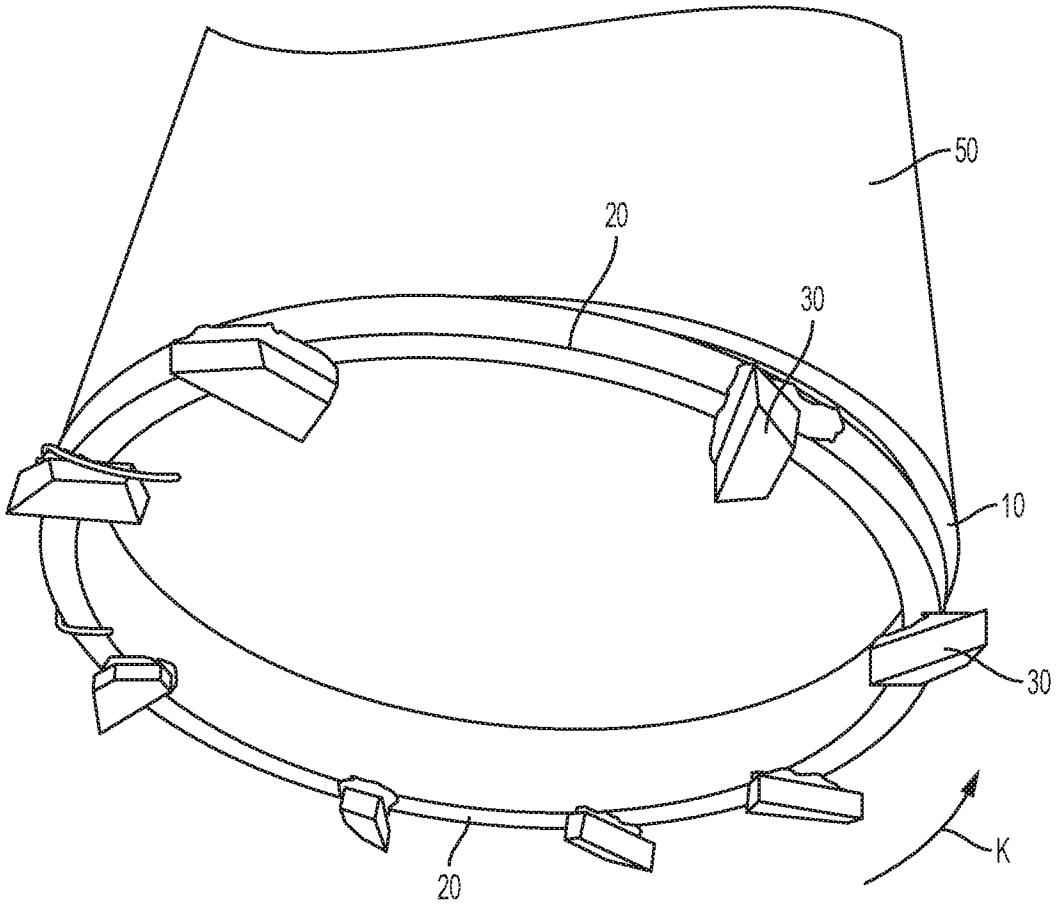
FIG. 1 is a perspective view of an embodiment of an auger annulus of the disclosed technology, affixed to a wrapped jacket in accordance with the methods of the disclosed technology.
Figure 2:
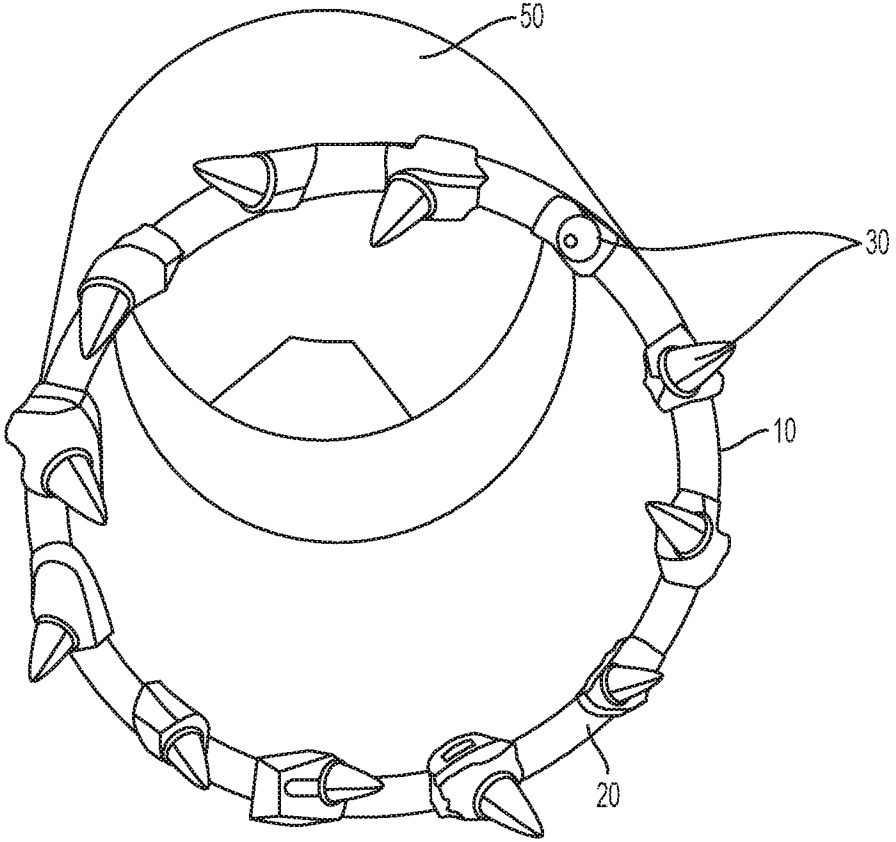
FIG. 2 is a bottom view of another embodiment of an auger annulus of the disclosed technology, affixed to a jacket.
Figure 4:
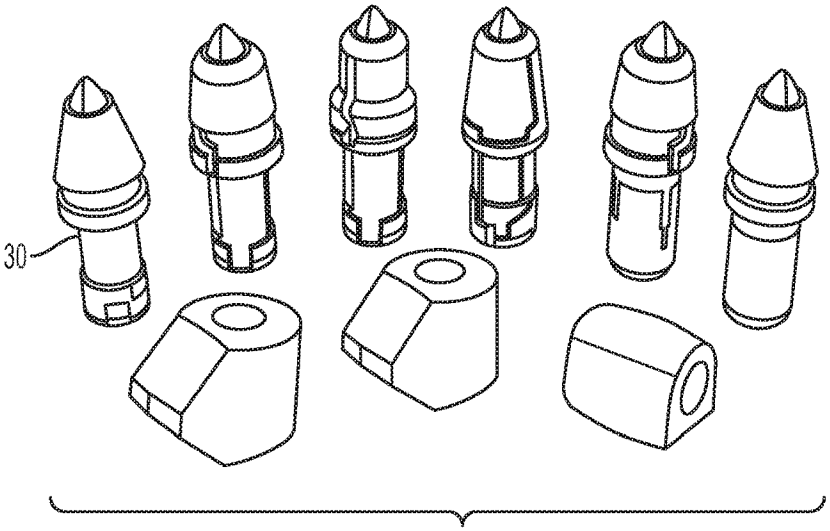
FIG. 4 is a perspective view of blades and block holders suitable for affixation to the auger annulus of the disclosed technology.
Figure 3:
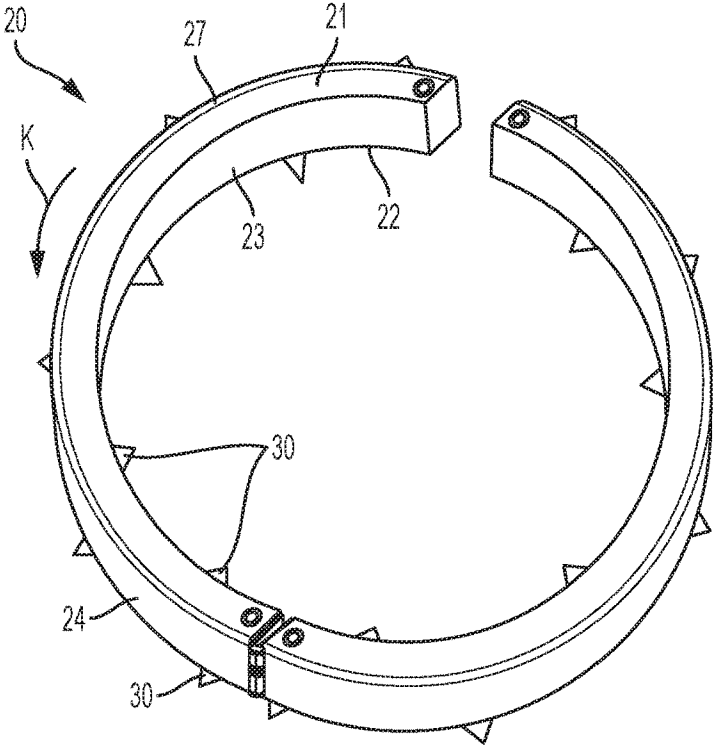
FIG. 3 is a perspective view of an embodiment of the arced members of the auger annulus of the disclosed technology.

The auger annulus 10 of the disclosed technology includes a plurality of arced members 20, an embodiment of which is shown in FIGS. 1-3. The arced members have a curvature K, which when joined form a circle. As shown in FIG. 3, each arced member has a top surface 21, a bottom surface 22, an interior side surface 23 and an exterior side surface 24, which surfaces define generally top, bottom, interior and exterior planes, respectively. In some embodiments one or more of the arced members 20 are hingedly affixed at one end to another of the arced members; non-affixed ends may comprise corresponding apertures for receiving bolts and nuts to secure the members about the joint for use with the system and method of the disclosed technology. The arced members may be manufactured from steel, having for example a ¾" thickness, being about 3" high.

Each arced member 20 has one or more blades 30 affixed directly or indirectly to, and extending from, the bottom surface 22 of the arced member. In some embodiments, as shown in FIG. 1 the blades extend perpendicularly from the bottom surface 22 of the arced member, with a portion of the blades extending beyond the interior side plane, the exterior side plane, or both the interior and exterior side planes, of the members. In some embodiments, as shown in FIG. 2, the blades 30 are indirectly affixed to the members 20 by block holders 31 (shown in FIG. 4) or other support structure secured to the bottom surface of the members; alternatively, the blades may be affixed to the bottom surface 22 of the member (see, FIG. 1). The blades 30 have a top surface and a bottom surface, the top and bottom surfaces terminating in a cutting edge, where the thickness of the blade between its top and bottom surfaces is at least 1". The blades may extend 1-2" from the bottom surface 22 of the annulus 10 by means of a block or similar structure, providing a gap of at least 1" between the bottom surface of the arced member and a top surface of the blade, rendering sufficient clearance between the blades so that when the annulus is driven down into the earth to, for example, a desired bore depth, the loose soil and rock will be pushed aside through the vacuous areas between the blades. In some embodiments, the blades 30 are affixed (directly or indirectly) to the arced members 20 so that a central axis of each of the blades extends at one or more angles $\alpha$ (e.g., 45°) relative to the curvature K of the member (see, e.g., FIG. 2). In these and other embodiments the blades may be affixed at one or more angles $\beta$ (e.g., 15°) relative to the bottom plane of the member. In some embodiments the blades 30 are juxtaposed to one-another for maximum efficiency, including hard rock cutting. Suitable blades useful in the auger annulus, the system and the method of the disclosed technology include simple wedges (FIG. 1), or may include auger bullet teeth (FIG. 4) or other blades having multiple teeth or fingers with angles and/or planes, such as those used in mining and rock-cutting operations.

The auger annulus 10 may be molded or otherwise made from a metal, such as high strength tempered steel. In some embodiments the blades 30 are made from the same material as the annulus, or another metal, or may even be made from diamonds, wherein for example the blade is a diamond bit of a fin shape.

As shown in FIGS. 1 and 2, the auger annulus 10 is adjoinable to the base of a shell or jacket 50 of the system of the disclosed technology. In some embodiments the top surface 21 of each of the arced members 20 has a recess 27 about its circumference so that when the arced members are joined, the recesses 27 define a generally circular recess to receive a base edge of the shell or jacket 50, as hereinafter described. In this and other embodiments, the auger annulus 10 has an outside diameter near or equivalent to the diameter of the jacket, and the recess 27 has a thickness about equal to the thickness of the shell/jacket 50.

As shown in FIGS. 5 an 6, a system of the disclosed technology is useful in encapsulating structural piles to below the earth's surface. The system includes a jacket 50 having a longitudinal cut extending the length of the jacket, and an auger annulus 10, such as the annulus hereinabove described, wherein the auger annulus is adjoined to or adjoinable to the base of the jacket/shell. The jacket 50 may include a plurality of cylinders 50A, 50B, longitudinally securable to one another, each cylinder having a corresponding longitudinal open cut along its length.

In some embodiments the jacket is constructed from a fiber-reinforced polymer, with glass strand fiber, having a thickness of between about ⅛"-¼"; thicker shells may be more suitable or necessary for longer columns, or in aggressive water conditions. Suitable shells for use in the method and system of the present technology include the FX-70® inert, corrosion-free jacket made with a glass strand material in a polymer matrix, readily available from Simpson Strong-Tie. These jackets have a tongue-and-groove seam along their length, allowing the jacket to be opened for installation about piles or other structures, and sealed when in place about a pile.

The jacket shell 50 can be customized for use in the present technology by controlling the resin properties, and the type and orientation of the fiber within polymer. Stronger material with a high strength-to-failure ratio may be required for use in the jacket depending on the compactness of the mud/earth into which the shell is being augered in accordance with the present technology. FX-70® is sufficiently strong for typical sandy soil and clay conditions.

As shown in FIG. 3, the auger annulus 10 may have a generally circular recess 27 to receive the base of the jacket 50 as hereinabove described, or otherwise. The auger annulus may be adjoined to the bottom of the jacket (or one of the cylinders) by means of an epoxy glue, such as polyurethane glue, and/or by riveting, bolting or fastening means, at an overlapping portion between the jacket/cylinder and the annulus. The seams or joint(s) of the shell may be fastened by riveting or bolting (or similar securing means), and/or bonded with glue. Simpson Strong-Tie's FX-763 low-modulus trowel grade epoxy is suitable glue for purposes of bonding the seams of the shell, having sufficient moisture tolerance to be suitable for most applications. The column of shells, when used, may be constructed before or after augering the system into the mudline or earth's surface, depending on the augering method used (e.g., to use a vertical load method in association with the bridge deck, the entire column should be constructed).

As shown in FIG. 6, once the shell column is formed by joining the auger annulus and the jacket, one or more layers of FRP wrap 60 are positioned about the exterior of the jacket, and may be positioned about a portion of the exterior of the auger annulus 10, but free from the blades 30. For example, G-05 Aquawrap®, a composite system made with bi-directional glass fibers and resin system available from Air Logistics Corporation, has been found suitable for use as the wrap 60 of the present application, and may be applied helically about the shell.

A method of encapsulating a structural pile to below the earth's surface is also provided, using a shell or jacket 50 and an auger annulus 10 such as those hereinabove described. In this method the jacket and the auger annulus are positioned and sealed or secured about the pile to form a shell column, and the auger annulus is adjoined to the jacket. When a plurality of cylinders 50A, 50B are used to form the jacket 50, the cylinders are secured longitudinally one to another (in some embodiments the cylinder's overlap to strengthen points of affixation), by, for example, epoxy or riveting, in some cases up to flush with the pile cap. When the pile is subjected continuously or from time to time to water, the first or lowest positioned cylinder may have a height that exceeds the sum of the designed bore depth and a maximum determined water depth to which the pile may be exposed. A fiber reinforced polymer wrap 60 is applied about the shell column, all as shown in FIG. 6.

With the jacket and auger annulus positioned about the joint, and secured to form the shell column, a force is applied to the shell column to cause the annulus to bore into the earth's surface to about the designed bore depth or another depth, based upon the soil conditions encountered in the boring process. The applied force may be torque, vibration, vertical load or combinations thereof. In some embodiments of this method vibration and/or vertical load are applied by equipment positioned on a structure supported by the pile.

In some embodiments a plate 61 may be positioned on the top of the jacket, and at least some of the applied force may be applied indirectly to the column by direct application to the plate. The use of a plate at the top of the shell ensures uniform distribution of the load (and result in the shell uniformly boring along a central axis into the earth). The plate may include a pair of semicircular plates which together have a diameter larger than the outer diameter of the jacket, and wherein each semicircular plate comprises an internal aperture to receive and surround the pile. The plate may be unsecured relative to the column, or secured in position on top of the shell column by welding and/or bolting.

Figure 8A:
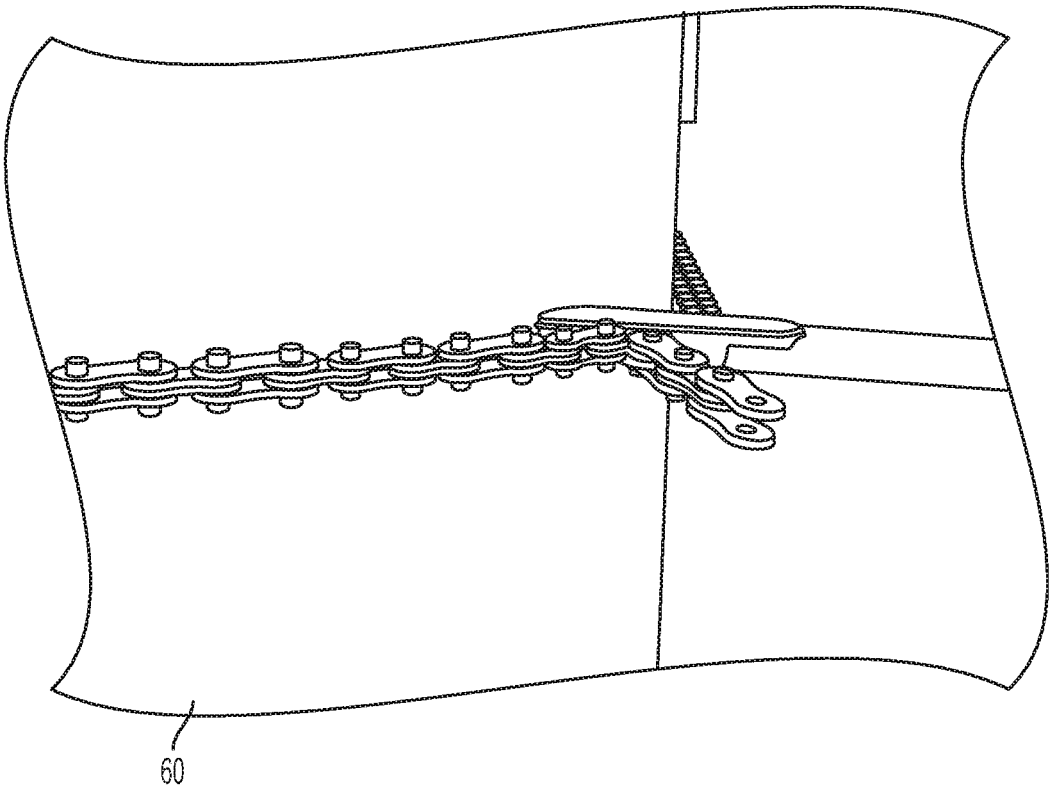
FIGS. 8A and 8B are different configurations of equipment designed to apply torque to the system of the disclosed technology, in accordance with the method of disclosed technology.
Figure 8B:
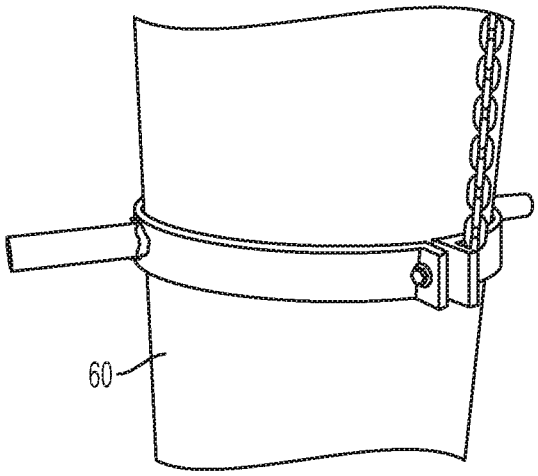

When used, torque may be applied to the shell column either manually or mechanically, thereby causing the system of the disclosed technology to bore into the earth, about the pile. For example, as shown in FIG. 8B, one or more split metal rings may be adjustably secured about the shell, positioned above the water line (e.g., 3-6'). The ring may be adjusted upward on the shell as the shell as it is driven into the earth. In some embodiments at least two steel cylindrical tubes (e.g., 6" in length) are welded on each ring, adequately spaced apart to allow one or more persons to grasp the tubes and generate torque on the shell by rotating the shell and pushing it into the earth. Alternatively, the split ring may be fastened by chains to a chain crank and a smaller crank on the shaft of a motor, and torque may be generated mechanically by running the chain over both of the cranks. In some embodiments the chain crank and/or smaller crank are powered by a gear reduction motor with suitable torque (e.g., 1200-1500 ft lbs.). In another embodiment a winch with a lopped cable may be used to generate torque on the shell-ring system (see FIG. 8A).

Vibration and vertical load can also be applied to the shell-ring system, with or without torque, to cause the system of the present technology to bore into the earth. Vibration and vertical load can be applied from the bridge deck, wherein a vibrating mechanism (e.g., by means of shaking with an excavator or back hoe) can be attached to the top of the shell, and the vertical load can be applied to the shell by a hydraulic jacking mechanism (of the excavator or other machine providing downward thrust), positioned between the plate and the bridge deck or another structure, which applies downward forces to the shell using the gravity load or the self-weight of the bridge deck as the jacking reaction mechanism. In another embodiment, vertical load can be applied to the shell by dead weight (e.g., sand bags or other materials), which may be positioned and secured upon a plate over the top of the shell.

Figure 7:
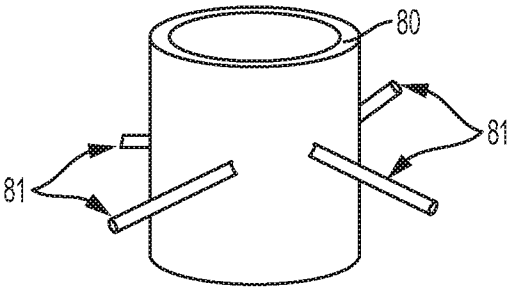
FIG. 7 is a perspective view of studs secured around a pile in accordance with an embodiment of the method of the disclosed technology.

As shown in FIG. 7, in some embodiments of the method of the disclosed technology, shear studs 81 are secured on the exposed base of the pile 80, extending radially from the pile toward the jacket, thereby transferring vertical load from the pile to the shell column. The studs may be in a single plane dissecting the shell column, or in one or more different planes. These studs may be ½" diameter, 3-4" length studs, positioned uniformly about the pile, above or below the waterline, at un-corroded segments of the pile.

Upon boring to the about bore depth, the base of the shell column may be filled with polymer concrete to form the base thereof and minimize moisture uptake into the column to prevent any corrosion activity. Preferably this layer of polymer concrete is about 12-18" in depth. In some embodiments this polymer concrete is an epoxy concrete with high strength, low moisture absorption and high resistance to chemical and aggressive water environment, without dewatering. Simpson StrongTie's FX-70-6MP multipurpose marine epoxy grout, a water tolerant grout specifically designed for underwater applications, has been found suitable for this application.

A cementitious composition may then be inserted into the chamber of the shell column, to or near the top of the column, to fill the annular space between the pile and the shell, up to or near the top of the shell. In some embodiments the cementitious composition is self-consolidated concrete. The cementitious composition may be poured into the chamber by means of one or more chutes positioned in the chamber of the shell column. The chute(s) may be wooden, or any similar material, and may have a chamfered interior. In some embodiments the chute may have a cross-section of 9×9" to 12×12", although a larger cross-section may be desirable for larger shells. The chutes typically have a length designed to extend the length of the column, from the layer of polymer concrete to the top of the pile cap.

In some embodiments the top of the shell column may be wrapped with FRP wrap (using, for example, 2-3 layers of G-05 Aqua Wrap®, helically applied about the top of the column) to further encapsulate the column and protect it from degrading environments and substances. In some environments a water-repellant paint may be applied to the exterior of the wrapped column.

While embodiments of the system and method of the present technology are described and shown in the present disclosure, the claimed invention of the present technology is intended to be only limited by the claims as follows.

The invention claimed is:

1. An auger annulus adjoinable to a shell useful in encapsulating structural piles above and below the earth's surface, the auger annulus comprising a plurality of arced members having a curvature and joinable to form a circle, the arced members being configured to adjoin with the shell to form a shell column for purposes of encapsulating structural piles above and below the earth's surface when the shell column is filled with a cementitious composition, wherein each arced member has a top surface, a bottom surface, and interior and exterior side surfaces, which surfaces define top, bottom and interior and exterior side planes, respectively, and wherein a plurality of blades are affixed to and extend from the bottom surface of the arced members, wherein a central axis of each of the blades extends at an angle relative to the curvature of the arced member to which the blade is affixed, wherein a portion of at least some of the one or more blades extends beyond the exterior side plane of the arced member to which the blade is affixed, and the same or other blades extend beyond the interior side plane of the arced member.

2. The auger annulus of claim 1, wherein the top surface of each of the arced members has a recess about its circumference so that when the arced members are joined they define a circular recess to receive a base edge of the shell.

3. The auger annulus of claim 1, wherein the one or more blades have a top surface and a bottom surface, the top and bottom surfaces terminating in a cutting edge, wherein the thickness of the blade between the blade top surface and the blade bottom surface is at least 1".

4. The auger annulus of claim 1, wherein the blades are affixed to the arced members at varying angles relative to the curvature of the member.

5. The auger annulus of claim 1, wherein the blades are affixed to the arced members at varying angles relative to the bottom plane of the member.

6. The auger annulus of claim 1, wherein the arced members each comprise a plurality of block holders affixed to the bottom surface of the member, each of the blades being affixed to the bottom surface of the arced member by means of one of the block holders.

7. The auger annulus of claim 6, wherein each of the blocks provides a gap of at least 1" between the bottom surface of the arced member and a top surface of the blade.

8. A system useful in encapsulating structural piles to below the earth's surface, the system comprising:

a. a jacket having a longitudinal cut extending from a top of the jacket to a base of the jacket; and b. an auger annulus adjoinable to the jacket comprising a plurality of arced members having a curvature and joinable to form a circle, each arced member having a top surface, a bottom surface, and interior and exterior side surfaces, which surfaces define top, bottom and interior and exterior side planes, respectively, and wherein one of the arced members is affixed to another of the arced members, wherein a plurality of blades are affixed to and extend from the bottom surface of the arced members, wherein a central axis of each of the blades extends at an angle relative to the curvature of the arced member to which the blade is affixed, and wherein a portion of at least some of the one or more blades extends beyond the exterior side plane of the arced member to which the blade is affixed.

9. The system of claim 8, wherein the jacket is constructed from a fiber-reinforced polymer comprising glass strand fiber.

10. The system of claim 8, wherein the jacket comprises a plurality of cylinders, the cylinders being longitudinally securable one to another.

11. The system of claim 10, wherein the auger annulus is adjoined to the bottom of one of the cylinders such that the cylinder overlaps a portion of the annulus.

12. The system of claim 8, wherein the top surface of each of the arced members has a recess about its circumference so that when the arced members are joined they define a circular recess to receive the base of the jacket.

13. The system of claim 8, wherein a portion of at least some of the one or more blades extend beyond the interior side plane of the arced member to which the blade is affixed.

14. The system of claim 13, wherein the blades are affixed to the arced members at varying angles relative to both the curvature of the member and the bottom plane of the member.

15. The system of claim 8, wherein the blades are affixed to the bottom surface of the arced member by means of a block, providing a gap of at least 1" between the bottom surface of the arced member and a top surface of the blade.

16. A system useful in encapsulating structural piles to below the earth's surface, the system comprising:

a. a jacket having a longitudinal cut extending from a top of the jacket to a base of the jacket;

b. an auger annulus adjoinable to the jacket comprising a plurality of arced members having a curvature and joinable to form a circle, each arced member having a top surface, a bottom surface, and interior and exterior side surfaces, which surfaces define top, bottom and interior and exterior side planes, respectively, wherein one of the arced members is affixed to another of the arced members, and wherein a plurality of blades are affixed to and extend from the bottom surface of the arced members, and the same or other blades extend beyond the interior side plane of the arced member; and c. a plate positionable at the top of the jacket, the plate designed and configured to facilitate the application of a force to the adjoined jacket and auger annulus, the force causing the auger annulus to bore into the earth's surface.

17. The system of claim 16, wherein a central axis of each of the blades extends at an angle relative to the curvature of the arced member to which the blade is affixed, and wherein a portion of at least some of the one or more blades extends beyond the exterior side plane of the arced member to which the blade is affixed.

18. The system of claim 17, wherein a portion of at least some of the one or more blades extend beyond the interior side plane of the arced member to which the blade is affixed.

19. The system of claim 16, wherein the one or more blades have a top surface and a bottom surface, the top and bottom surfaces terminating in a cutting edge, wherein the thickness of the blade between the blade top surface and the blade bottom surface is at least 1".

20. The system of claim 19, wherein the blades are affixed to the arced members at varying angles relative to the curvature of the member and at varying angles relative to the bottom plane of the member.

21. The system of claim 16, wherein the applied force comprises vibration.

22. The system of claim 16, wherein the applied force comprises vertical load.

23. The system of claim 16, further comprising a plurality of studs for securing radially from the pile to the jacket, wherein when the studs are so secured to the pile and the jacket is filled with a cementitious composition to form a shell column, load is transferred from the pile to the shell column.

24. The system of claim 16, wherein the plate comprises a plurality of adjoinable plate segments, and wherein when adjoined the plate segments together have a diameter greater than an outer diameter of the jacket, and wherein each plate segment comprises an internal aperture so that when adjoined, the internal apertures of the plate segments receive the pile.

25. The system of claim 16, wherein the jacket is constructed from a fiber-reinforced polymer comprising glass strand fiber.

26. The system of claim 16, wherein the jacket comprises a plurality of cylinders, the cylinders being longitudinally securable one to another.

27. The system of claim 26, further comprising a plurality of fiber reinforced polymer wraps for securing the auger annulus to one of the cylinders of the jacket, for adjoining the cylinders, and for securing the plate to the jacket.

* * * * *